United States Patent [19]

Shalom

[11] Patent Number: 4,951,323

[45] Date of Patent: Aug. 28, 1990

[54] AUTOMATIC SEAT LIFTING DEVICE FOR WATER CLOSETS

[76] Inventor: Levin Shalom, 8/9 Simtat Rodan, Haifa 35590, Israel

[21] Appl. No.: 409,235

[22] Filed: Sep. 19, 1989

[30] Foreign Application Priority Data

Nov. 25, 1988 [IL] Israel ..... 88486

[51] Int. Cl.[5] ..... A47K 13/10

[52] U.S. Cl. ..... 4/251; 4/236

[58] Field of Search ..... 4/251, 661, 241, 236, 4/248, 237, 240; 49/265, 379, 386

[56] References Cited

U.S. PATENT DOCUMENTS

| | | | |
|---|---|---|---|
| 752,321 | 2/1904 | Bacon | 4/251 |
| 1,333,747 | 3/1920 | Yoshinaga | 4/251 |
| 2,772,422 | 12/1956 | Knudsen | 4/251 |
| 4,551,866 | 11/1985 | Hibbs | 4/251 |

FOREIGN PATENT DOCUMENTS

| | | | |
|---|---|---|---|
| 145602 | 3/1952 | Australia | 4/251 |
| 60320 | 10/1942 | Denmark | 4/251 |
| 48808 | 8/1988 | France | 4/251 |

*Primary Examiner*—Henry K. Artis

*Attorney, Agent, or Firm*—Frishauf, Holtz, Goodman & Woodward

[57] ABSTRACT

A toilet seat is provided with a device for lifting it automatically whenever the toilet cover is lifted, and for leaving both seat and cover in place on the bowl after the cover has been lowered. For this purpose the seat is fastened to the bowl by two long screw-threaded bolts which extend below the rear ledge of the bowl and whereof one bolt is longitudinally perforated for insertion of a flexible cable. A tubular guide is adjustably and concentrically screwed onto the bolt end and contains a helical spring. The cable extends through the spring and its lower end is connected to the bottom end of the spring by a plug which can move inside the tubular guide, while its upper end is wound around the hub of the toilet seat. The spring is tensioned by adjusting the position of the tubular guide along the screw-threaded bolt, so as to exert a force on the plug and through the cable on the hub of the seat of a magnitude sufficient to raise the seat alone, but not both the seat and the toilet cover.

6 Claims, 2 Drawing Sheets

AUTOMATIC SEAT LIFTING DEVICE FOR WATER CLOSETS

BACKGROUND OF THE INVENTION

The invention relates to water closets, more especially to a device for automatic lifting a toilet seat off the bowl of a water closet after use, and for keeping it on the bowl, while the toilet cover is closed and lowered onto the seat.

In public lavatories or restrooms, but also in lavatories in airports, concert halls, restaurants, hotels, assembly halls, and other public places, the toilet seats are frequently soiled and made unsuitable for subsequent users by people urinating into the bowl without lifting the seat. It also happens that the seat is covered with faeces after use, by toilet paper which was intended to be dropped into the bowl, but accidentally hits the seat. With primitive people it also happens that they step onto the seat proper while using the toilet, which not only soils but often damages it. In addition, automatic lifting the seat off ther bowl would be beneficial in houses with many children, especially boys.

Therefore, it has long been found necessary to provide a device which will automatically lift the toilet seat off the bowl rim as soom as the previous user has got up until it is lowered by the next user for sitting on it. The known devices mostly consist of a spriral spring wound about the axle of the seat, which is tensioned when the seat is on the bowl and uncoils, thereby forcing the seat up into more or less vertical position. The spring should be just strong enough to lift the seat off the bowl while the cover is lifted, but not so strong that it will lift it when it is covered by the lowered toilet cover.

These devices have two inherent drawbacks: 1. they are not adjustable after their first fitting in the water closet installation, and in all cases where the spring force decreases, they will stop operating. 2. Since the spring is to be strong enough to lift the seat from its horizontal position, while the lifting moment is the greatest, it accelerates the seat and throws it up rather vehemently, causing it to bang against the cover and to make unpleasant noise. It is true that the spring force decreases while it somewhat uncoils, but it is the inertia of the mass which continues driving the seat about its axle, assisted by the spring force.

For these reasons it is the object of the present invention to provide a seat-lifting device of the above kind which is fully adjustable from the beginning to adapt its lifting force to any weight of both the seat and the cover, and which is subsequently adjustable for compensating for changes in the spring force, increased friction in the bearings or other causes.

The invention has as its other object to make the device adjustable by any housewife or other unskilled person without the use of special tools.

It is another object to prevent acceleration of the seat movement about its axle and thereby preventing its loud banging against the toilet cover.

It is a still another object to provide a device having a clean and smooth surface lending itself to ready cleaning and wiping.

And it is a final object to provide such device at low cost so as to enable any public lavatory and even every household to install a seat-lifting device to every water closet in the place.

SUMMARY OF THE INVENTION

A toilet seat is generally pivotally movable about horizontal axles which are fastened to the rear of the toilet bowl by vertical bolts extending through holes in a ledge extending from the bowl to the rear and held in position by nuts tightened against the underside of the ledge. The seat includes, for this purpose, two hubs at its rear end which are rotatably mounted on these axles. In most cases the seat is covered by an oval cover which is likewise pivotally mounted on the same axles. With a view not to carrying out extensive modifications to the bowl and the seat, the present device is designed to utilize the existing fastening means as far as possible: the device, therefore, consists essentially of a pliable cord, fastened at its one end to, and wound around, the hub of the seat and extending through a bore in the vertical bolt underneath the ledge of the bowl, where its bottom end is fastened to a bobbin freely movable in a tubular guide. The guide has an open bottom end and a solid top which is perforated by internal screw thread corresponding to the screw thread of the vertical bolt, serving to fasten the guide to the bolt in variable longitudinal alignment. A helical spring is positioned inside the tubular guide between the solid top and the bobbin in compressed, pretensioned state, the tension being defined by a moment that will be sufficient to raise the seat off the bowl, whenever the cover is open, while it will be insufficient to raise the seat together with the cover. Adjustment of the spring tension is carried out by rotating the tubular guide so as to raise or to lower it along the vertical bolt, thereby changing the length of the compressed spring. Although one device fastened to one side of the seat may be sufficient to lift the seat off the bowl, two devices, one on each side of the seat, may be provided, thereby permitting the use of weaker springs.

In order to prevent sudden jerking of the seat into open position, the bobbin is preferably shaped to form a piston adapted to be moved up and down in the smooth, cylindrical bore of the tubular guide, which is closed at its bottom end to form a closed cylinder, except for a small orifice in its bottom. The downward movement of the piston will create a light overpressure in the bottom space of the cylinder-tubular guide and thereby slow down the motion of the spring and prevent jerking up of the seat. In addition, the piston may be provided with a central bore effecting communication between the upper and lower cylinder space which is normally closed by a valve which opens and permits air to flow through the bore and thereby equalize the pressure, whenever the seat is too vehemently pushed down, with a view to preventing damage to the mechanism.

With the object of facilitating insertion of the cord, the vertical bolt and the plug are preferably slotted lengthwise to the width of the cord, permitting its sideways introduction through these slots.

In a simplified embodiment of the invention the tubular guide may be omitted altogether and replaced by a nut-shaped spring-support movable along the screwthread of the vertical bolt, whereby the helical spring is tensioned between this support and the plug at the end of the cord.

SHORT DESCRIPTION OF THE DRAWINGS

FIG. 1 is a vertical section through a seat-lifting device, showing the seat and the cover in "closed" position, and FIG. 2 is a vertical section through a seat-lifting device similar to that illustrated in FIG. 1, provided with an additional damping mechanism.

DETAILED DESCRIPTION OF THE DRAWINGS

Figure 1:
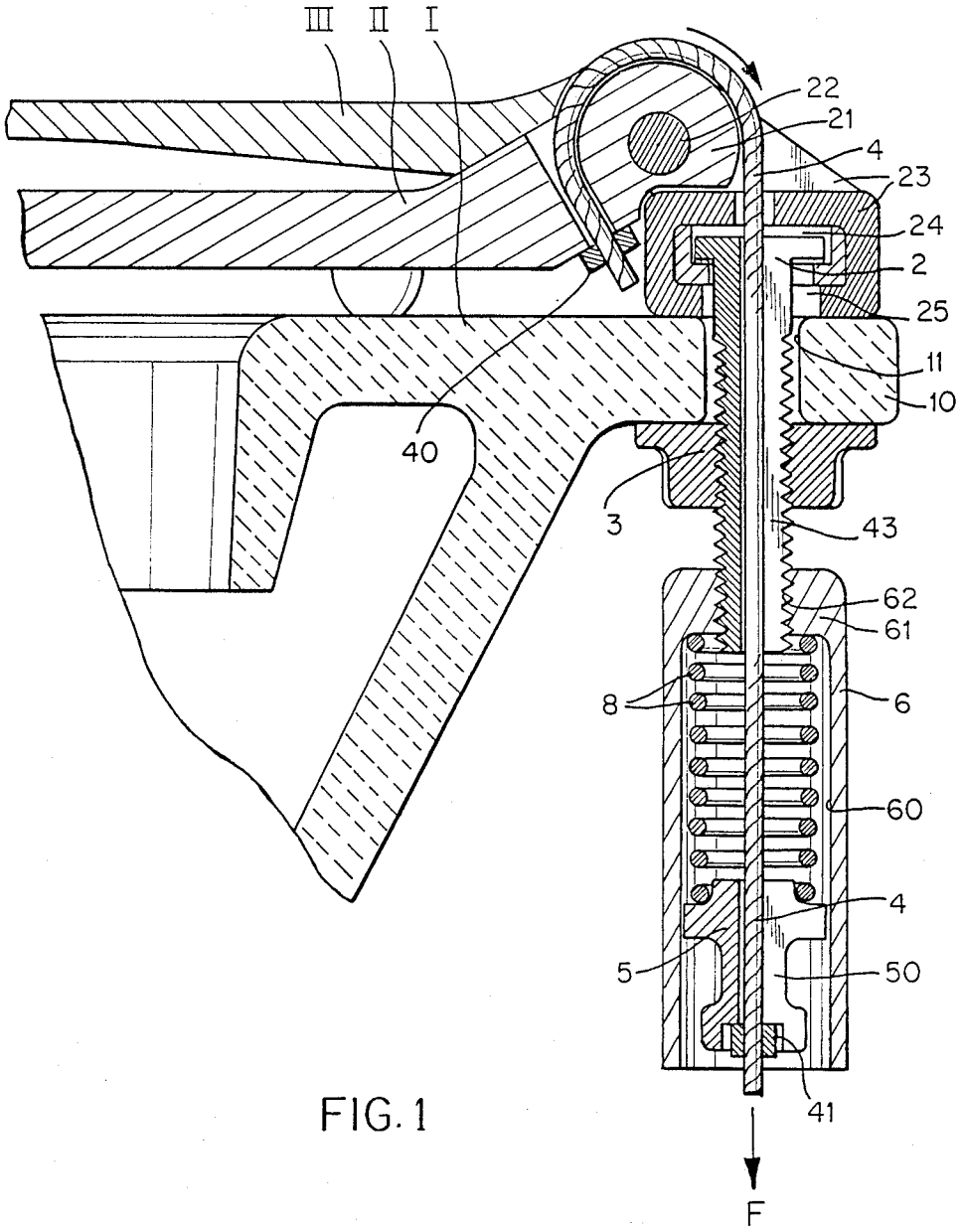

Referring now to FIG. 1 of the drawings, a toilet bowl I contains a horizontal ledge 10 at its upper rear end which is perforated by (usually) two vertical holes 11. A toilet seat II and a cover III are shown to be positioned on the upper surface of the bowl, the cover on top of the seat. The seat includes a cylindrical hub 21 on each side, each being pivotally fastened to a horizontal axle 22, which is held by a bracket 23, while the latter is provided with a horizontal groove 24. The bottom of the groove is open towards the ledge surface in the form of a slot 25, serving to connect the bracket—on each side of the toilet—to the ledge 10 of the bowl. This connection is made by means of a hammer-head-bolt 2 which engages the channel by means of its head and is tightened onto the ledge by means of a nut 3 on its underside. As can be seen from the drawing, the bolt 2 is slotted lengthwise (43) for the purpose of facilitating insertion of a cord or cable 4 into its center. Two clamps 40 and 41 are fastened to the ends of the cord or cable, the upper clamp 40 serving to attach the cable to the seat II, which surrounds the hub 21 about an angle of about 200°, while the second clamp 41 engages the bottom end of a bore in a plug or bobbin 5 which is slotted, similar to the bolt 2, by a slot 50. The plug or bobbin 5 is movable in the smooth bore 60 of a tubular guide 6, the latter including a solid top 61 and an open bottom end. The top is axially perforated by a screw-threaded bore 62 permitting its being rotated and shifted along the bolt 2 in upward or downward direction. A helical spring 8 is positioned inside the guide between its solid top and the plug or bobbin 5 in compressed state, urging the plug and the attached cord or cable 4 in downward direction, as indicated by arrow F.

The spring 8 is compressed to a tension so as to exert the exact moment on the hub 21 and the seat which will lift the seat alone off the bowl, but not together with the cover. This tensioning is carried out by rotating the guide about the bolt thread in upward or downward direction, upward movement lengthening the spring and reducing the tension, and vice versa. In this way the seat will always be in raised state as long as the cover is up, and will stay closed together with the cover, after this has been lowered. Of course, it may be possible to provide the seat-lifting device to a water closet provided with a seat without a cover, and in this case the calibration need not be as exact as in the first case.

Figure 2:
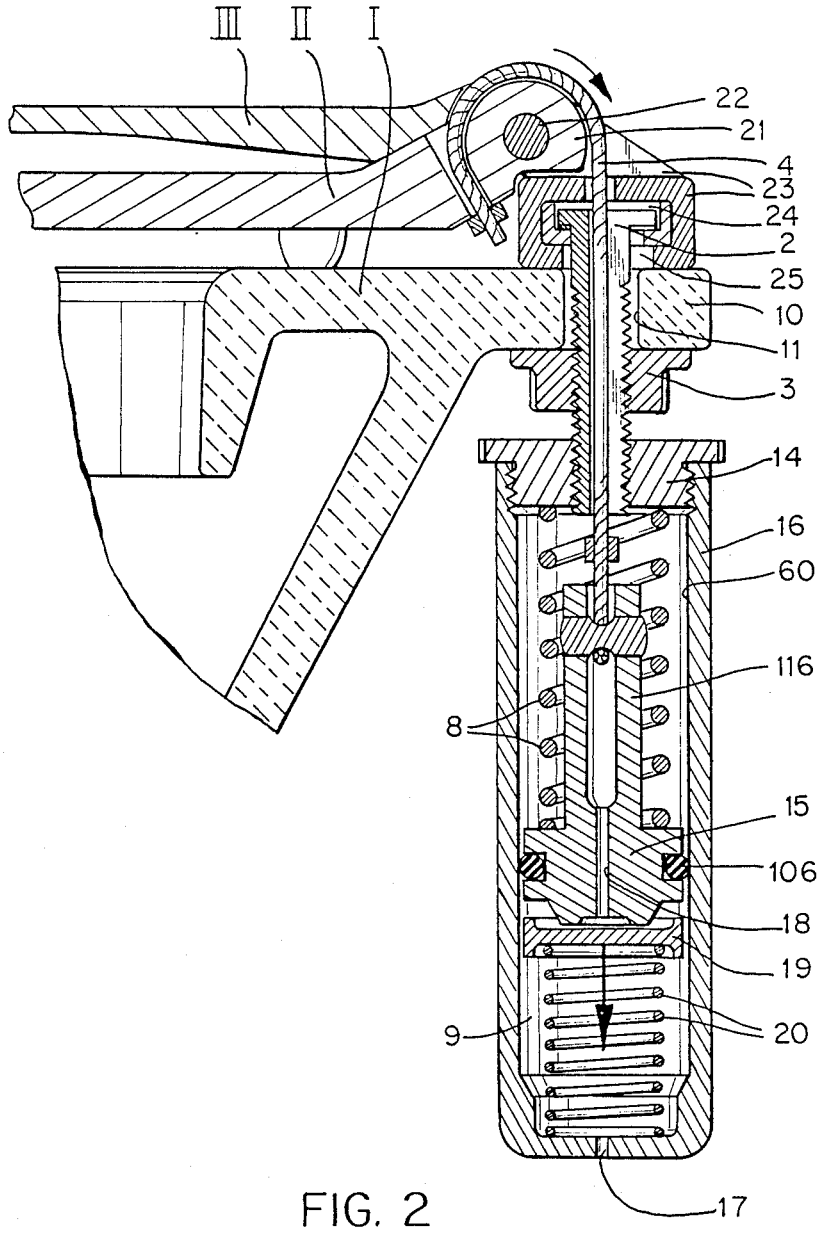

The embodiment of a seat-lifting device illustrated in FIG. 2 is in most of its parts identical with that shown in FIG. 1, and identical components are designated by identical numerals in both drawings. The main difference between the two embodiments is the addition of a motion-damping mechanism intended to prevent the seat from jerking up and from striking the cover too hard and noisily. The introduction of this damping mechanism requires some changes to the shape of the tubular guide and the bobbin, as follows: The tubular guide 16 serves as a cylinder for the bobbin which acts as a piston in the cylinder by the addition of an O-ring 106. The piston is upwardly extended to form a bar-shaped spring-guide 116 the upper end of which is attached to the end of the cord 4 by means of a loop. The tubular guide or cylinder 16 is closed at its upper end by a plug 14 which is provided with axial internal screw-thread corresponding to that of the bolt 2 and permitting up and down movement of the guide cylinder along the bolt. It bottom end is likewise closed except for a small hole or orifice 17. The spring 8 is positioned in the space between the plug 14 and the piston 15 urging the latter in downward direction and tensioning the cord 4. As soon as the cover III is lifted or a person gets up from the seat, the spring 8 expands and pushes the piston 15 and the cord 4 downward, thus rotating the hub 21 about its axle 22 and lifting the seat off the bowl I. However, in contradistinction to the action of the device of FIG. 1, there exists a slowing-down of the movement owing to the braking effect of the piston inside the guide cylinder which creates a light overpressure in the lower cylinder space 9, since air escapes the space through the bore 17 at a slowe rate only, thereby slowing dowm the motion of the piston and of the seat itself.

However, there is provided a safety device in the piston serving to prevent damage to the mechanism by sudden lowering of the seat from its raised position, which would create a slight vacuum in the lower cylinder space 9. This device includes a small central bore 18 in the bottom portion of the piston which connects the upper cylinder space with the lower cylinder space and is normally closed by a valve disc 19 urged onto it by a weak spring 20. Now, when the seat is pressed down and the piston is pulled up inside the cylinder 16, the vacuum in the space 9 pulls the valve disc 19 off its seat against the force of the spring 20, permitting air to flow from the upper into the lower space, thus obviating any resistance to the piston motion. The hole 17 in the bottom of the guide cylinder permits atmospheric air to enter the space and to equalize any pressure differences.

As mentioned in the introduction, another embodiment may be designed wherein the tubular guide is omitted altogether and the spring is placed into the space between a screw-threaded plug similar to that designated 14 in FIG. 2 and a bobbin 5 like that shown in FIG. 1. Adjustment of the spring tension is carried out by rotating the plug 14 on and along the bolt 2, with the same effect as that attained by the device illustrated in FIG. 1. The only drawback of this embodiment would be the exposure of the spring to dirt and a less smooth exterior of the entire device.

It will be understood that the devices shown in the drawings represent only two examples of the possible embodiments of the invention, and that various alterations and modifications may be carried out to it by a person skilled in the art, within the scope of the appended claims.

I claim:

1. A device for automatically lifting a toilet seat off a toilet bowl, said bowl containing said seat and a cover on top of said seat, wherein said seat is provided with two hubs in its rear portion pivotally mounted on horizontal axles, and wherein said toilet bowl is provided with a rearwardly extending horizontal ledge perforated by at least two vertical holes serving for firmly attaching said axles to said bowl by means of suitably formed brackets and two screw-threaded bolts and nuts clamping each said bracket to said ledge, said device comprising:

a perforation extending through the entire length of at least one of said screw-threaded bolts, a flexible core of cable fastened at its upper end to at least one side of said seat in front of said hub and extending along the upper surface of said hub to the rear and through saif perforation in said at least one screw-threaded bolt and terminating at a predetermined distance from the underside of said ledge, a bobbin fastened to the bottom end of said cord or cable in axial alignment, a plug provided with axial internal screw thread movably mounted on the lower protruding portion of said at least one screw-threaded bolt, a helical spring inserted into the space between said plug and said bobbin and tensioned by suitably adjusting the distance between said plug and said bobbin by rotation of said plug on said at least one screw-threaded bolt, tension of said spring being defined by a moment exerted by said cord or cable on said hub and said seat which is sufficient to lift said seat off said bowl whenever said cover is in an open position, and which is insufficient to lift both said seat and said cover in a closed state.

2. The seat-lifting device of claim 1 including a tubular guide incorporating and screw-threaded plug as its top portion, said guide extending downwards to cover said helical spring and said bobbin.

3. The seat-lifting device of claim 2 wherein said tubular guide has an inner bore slightly larger than the outer diameter of said bobbin.

4. The seat-lifting device of claim 2 wherein said tubular guide is closed at its top and at its bottom end and has a smooth inner bore thus converting said tubular guide into a cylinder, and wherein said bobbin is provided with sealing means on its periphery so as to convert it into a piston movable in said smooth bore of said cylinder, whereby during downward motion of said bobbin-piston owing to expansion of said spring a light overpressure is created in the bore space below said piston serving to slow down the downward motion of said piston and said cord, and thereby that of the upward motion of said seat.

5. The seat-lifting device of claim 4 including a small hole or orifice in the closed bottom of said cylinder permitting compressed air in said lower cylinder space to escape into the open during lifting of the seat.

6. The seat-lifting device of claim 4 including a duct in said bobbin-piston effecting communication between the bore space above said piston and the bore space below said piston, said duct being closed by a spring-supported valve during the downward motion of said piston, during automatic lifting of said seat, and is opened by upward motion of said bobbin-piston during manual lowering of said seat onto said bowl, by vacuum created in the lower bore space and equalizing of pressure in the said upper and lower cylinder spaces, thereby reducing the resistance to lowering of said seat and protecting said cord or cable from undue stress.

* * * * *